US006422797B2

(12) United States Patent
Pas

(10) Patent No.: US 6,422,797 B2
(45) **Date of Patent: *Jul. 23, 2002**

(54) BINDING ELEMENT FOR BINDING A STACK OF DOCUMENTS COMPRISED OF LOOSE SHEETS

(75) Inventor: David Pas, Antwerp (BE)

(73) Assignee: Esselte N.V., Sint-Niklaas (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/332,937

(22) Filed: Jun. 15, 1999

(30) Foreign Application Priority Data

Jun. 15, 1998 (DE) ..... 198 26 539

(51) Int. Cl.[7] ..... B42B 5/00

(52) U.S. Cl. ..... 412/33; 24/67 R; 24/67 B; 24/67.9; 72/342.5; 148/563; 148/402; 281/21.1; 281/36; 281/28; 281/29; 281/45; 402/35; 402/73; 402/74; 402/78

(58) Field of Search ..... 412/33; 281/21.1, 281/36, 28, 29, 45; 402/35, 73, 74, 78; 24/67 R, 67 B, 67.9; 148/563, 402; 72/342.5

(56) References Cited

U.S. PATENT DOCUMENTS

| | | | | |
|---|---|---|---|---|
| 4,493,495 A | * | 1/1985 | Linn | 281/45 |
| 4,506,416 A | * | 3/1985 | Ohminato et al. | 281/45 |
| 4,808,246 A | * | 2/1989 | Albrecht et al. | 148/402 |
| 4,934,738 A | | 6/1990 | Colonna | |
| 5,636,869 A | * | 6/1997 | Holmes | 281/45 |

* cited by examiner

*Primary Examiner*—A. L. Wellington
*Assistant Examiner*—Mark T. Henderson
(74) *Attorney, Agent, or Firm*—Jones, Tullar & Cooper, P.C.

(57) ABSTRACT

The present invention relates to a binding element for binding a stack of documents comprised of loose sheets, having a spine piece and two side pieces, the side pieces being arranged essentially perpendicular to the spine piece. The binding element is made of a shape memory material or has at least part of the binding element made of a shape memory material.

10 Claims, 5 Drawing Sheets

Fig. 7a
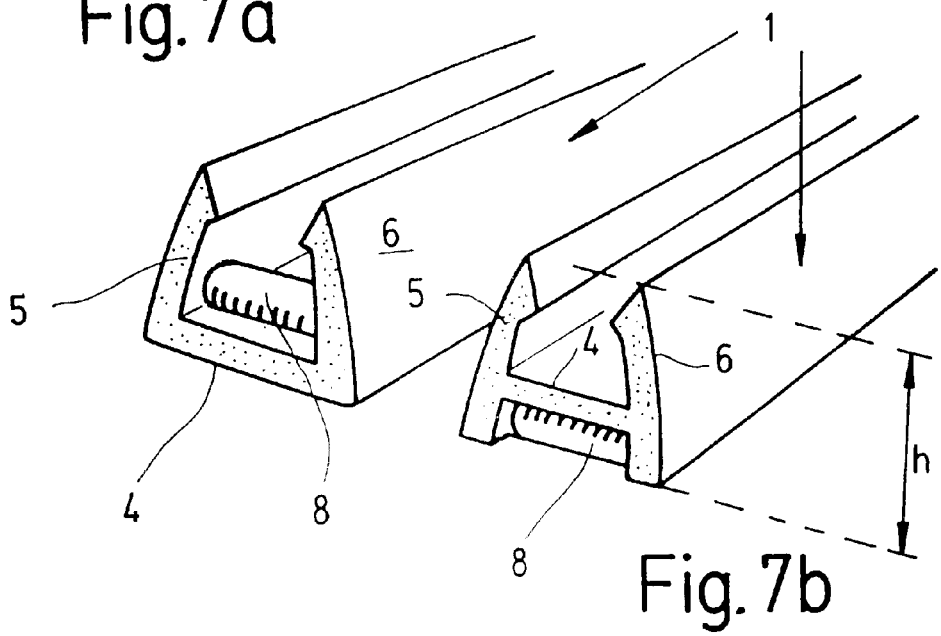
Fig. 7b
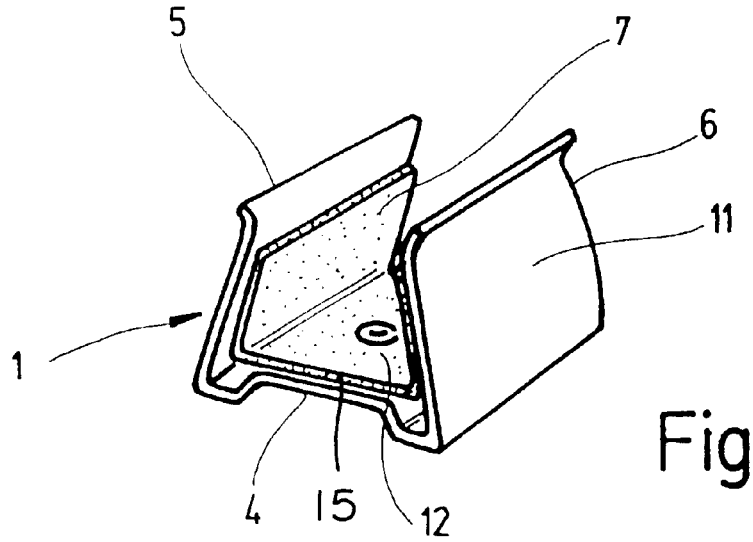
Fig. 8

BINDING ELEMENT FOR BINDING A STACK OF DOCUMENTS COMPRISED OF LOOSE SHEETS

BACKGROUND OF THE INVENTION

This invention relates to a binding element for binding a stack of documents comprised of loose sheets, having a spine piece and two side pieces, the side pieces being arranged essentially perpendicular to the spine piece.

SUMMARY OF THE INVENTION

It is an object of the present invention to provide a low-cost and easy-to-use binding element.

This object is accomplished by having the binding element made of a shape memory material or by having at least part of the binding element made of a shape memory material.

According to an advantageous further feature of the binding element of the present invention, provision is made for the two side pieces to be biased toward each other at room temperature, whereby a clamping force is exerted on the sheets of the stack of documents inserted in the space between the side pieces; to open the binding element and to insert or remove sheets of the stack of documents, the binding element is heated to a temperature that is higher than room temperature and which has been preset in the shape memory material. When the preset temperature is reached, the binding element adopts a position in which the two side pieces are spread open relative to each other.

The binding element of the present invention can be constructed in very different ways. Thus according to a first variant, the entire binding element extending either over the full length of a side edge of the stack of documents or over only a certain sub-section is made of a shape memory material. This variant is relatively expensive, so an alternative solution provides only for parts of the binding element to be made of shape memory material. Either these parts are inserted in the material of the spine piece and/or the side pieces, or they are fastened to it and/or them.

This requires the spine piece, or at least the side pieces of the binding spine, to be made of a material whose elastic force is smaller than the elastic force of the shape memory material. Once this condition is fulfilled, the form of the binding element is determined by the preset form of the shape memory material which it adopts upon reaching a predetermined temperature.

An advantageous embodiment of the binding element of the present invention provides for the part or parts made of shape memory material to be a spring or a strip-shaped part or a wire. These parts, such as springs, are fastened in accordance with a first embodiment between the two side pieces above the spine piece of the binding spine; if provision is made for the spine piece to be in the center zones of the side pieces, it is possible for the spring to be fastened between the two side pieces underneath the spine piece.

Furthermore, the part or parts made of shape memory material can have essentially the form of the binding element with its spine piece and side pieces. They are then arranged either inside the binding spine or outside the binding spine. It is also possible, however, for them to be incorporated as an integral component of the binding spine.

In another advantageous feature, a further spine piece made of random material (cardboard, plastic, metal such as spring steel, etc.) and extending over the full length of the side edge of the stack of documents to be bound is fastened to the spine piece of the binding element or to the spine pieces of the individual parts of the binding element or binding spine.

A further advantageous aspect of the binding element of the present invention provides for the part or parts made of shape memory material to be an integral component of the spine piece and/or the side pieces of the binding spine, or for the part or parts to be fastened by suitable fastening means to the spine piece and/or the side parts of the binding spine.

BRIEF DESCRIPTION OF THE DRAWINGS

The present invention will be explained in more detail in the following with reference to the accompanying drawings. In the drawings.

FIG. 7*a* is a perspective view of the embodiment of FIG. 4*a;*

FIG. 7*b* is a perspective view of the embodiment of FIG. 4*b;*

FIG. 8 is a perspective view of a further embodiment of the binding element of the present invention;

DETAILED DESCRIPTION OF THE PREFERRED EMBODIMENTS

Figure 1A:
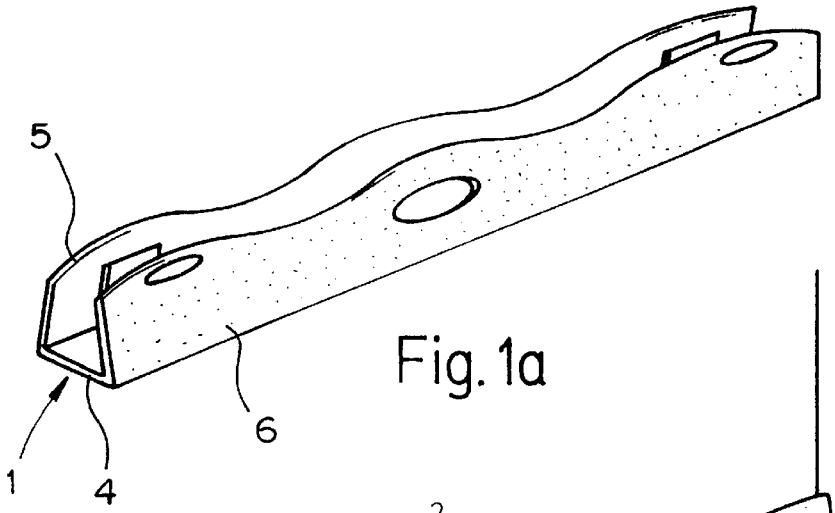
FIG. 1*a* is a perspective view of a first embodiment of the binding element of the present invention.
Figure 1B:
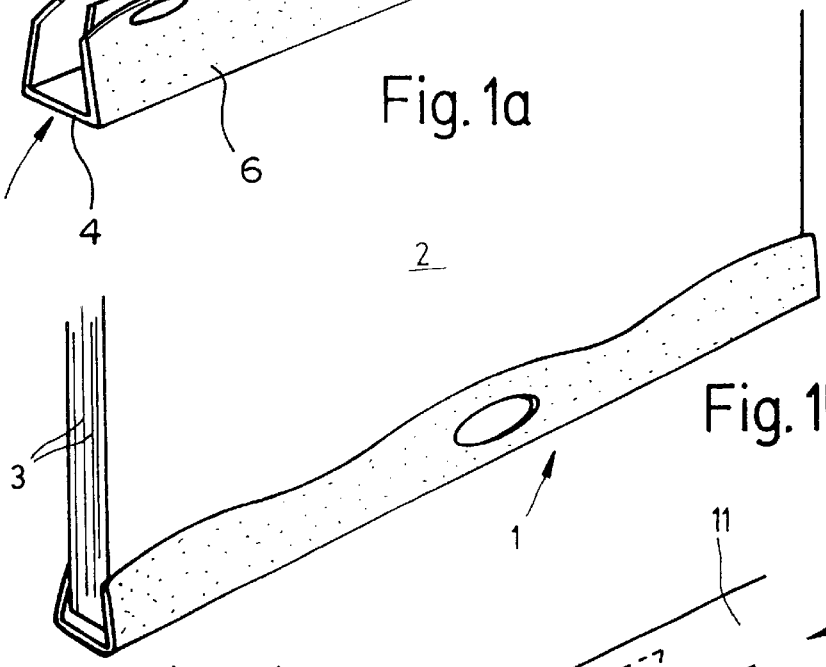
FIG. 1*b* is a view of the embodiment of FIG. 1*a* showing a bound stack of documents.

FIG. 1*a* is a perspective view of a first embodiment of the binding element of the present invention; FIG. 1*b* shows the embodiment of FIG. 1*a* with a stack of documents inserted. The binding element 1 is made of shape memory material. The shape memory material is either metal or plastic. The binding element 1 made of shape memory material has a spine piece 4 and two side pieces 5, 6, the side pieces 5, 6 being inclined and biased toward each other in the position in which they clamp the side edges of the sheets 3 of a stack of documents 2.

Shape memory material is distinctive in that it adopts a different form at room temperature, for example, than at a higher temperature. The temperature at which this different preset form is adopted can be varied over a wide range depending on the composition of the material. The present invention utilizes this effect to the extent that the binding element 1 is able at room temperature to clamp a stack of documents between two side pieces 5, 6, particularly between the upper edges of the side pieces 5, 6. At a preset higher temperature the two side pieces are spread apart, enabling the sheets 3 of the stack of documents 2 to be inserted or removed as desired.

According to a favorable further feature, a conventional thermal binding apparatus with a receiving channel is used for heating the binding element 1.

Figure 2A:
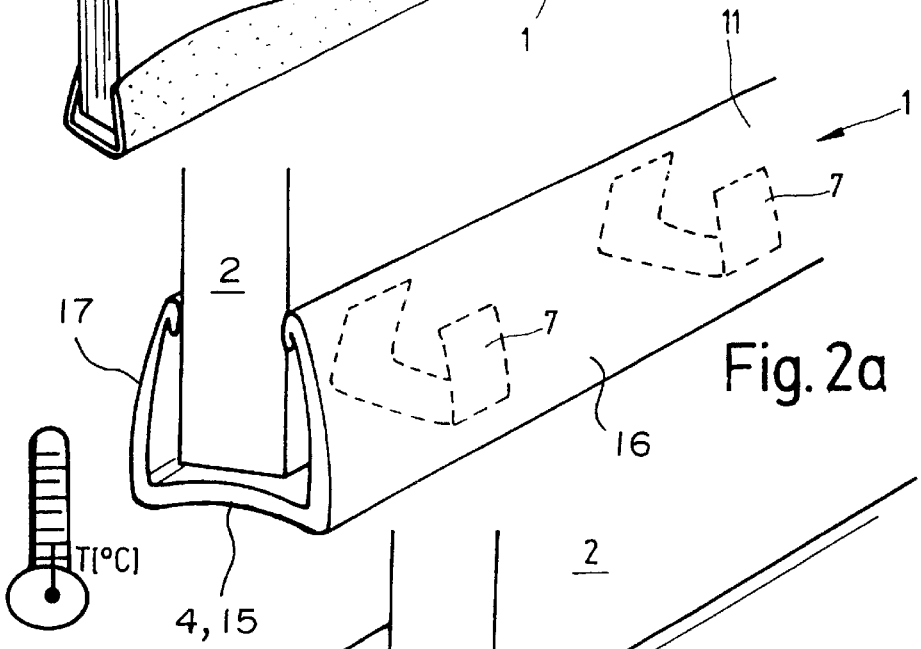
FIG. 2*a* is a view of a second embodiment of the binding element of the present invention, showing integrated parts made of shape memory material.
Figure 2B:
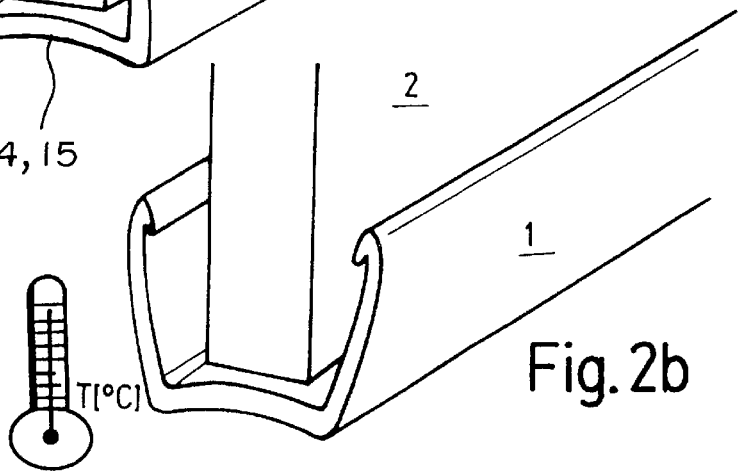
FIG. 2*b* is a view of the embodiment of FIG. 2*a* in open position.

FIG. 2*a* and FIG. 2*b* show a second embodiment of the binding element 1 of the present invention having integrated parts 7 made of shape memory material. The spine piece 15 and the side pieces 16, 17 of the binding spine 11 are made of a material with a smaller elastic force than that of the preset shape memory material so that the form of the binding element 1 is determined at all times by the form of the shape memory material. The actual binding spine 11 can be a low-cost injection-molded or extruded part, for example. Considering that in this embodiment the consumption of relatively expensive shape memory material is low, the corresponding binding element 1 is a comparatively low-cost item.

FIG. 2*a* shows the embodiment of the binding element 1 of the present invention with integrated parts 7 made of shape memory material binding a stack of documents 2 along one of its side edges at room temperature. FIG. 2*b* shows the corresponding binding element 1 at a higher temperature in open position.

Figure 3:
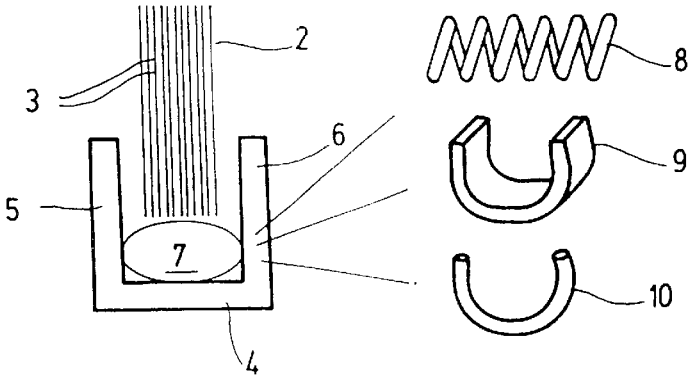
FIG. 3 is a schematic representation of a third embodiment of the binding element of the present invention.

FIG. 3 is a schematic representation of a third embodiment of the binding element 1 of the present invention. The part or parts made of shape memory material are optionally a spring 8, a strip-shaped insert 9 or a wire-shaped insert 10. How these parts 8, 9, 10 can be fastened to the spine piece 15 and/or to the side pieces 16, 17 of the binding spine 11 is illustrated in the cross-sectional views shown in the following FIG. 4, FIG. 5 and FIG. 6.

Figure 4A:
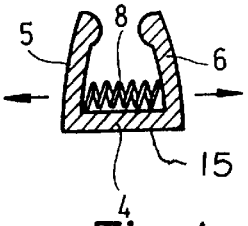
FIG. 4*a* is a cross sectional view of a first embodiment of the binding element of the present invention, utilizing a spring made of shape memory material.
Figure 4B:
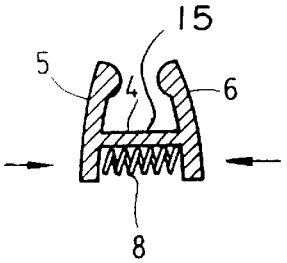
FIG. 4*b* is a cross sectional view of a second embodiment of the binding element of the present invention, utilizing a spring made of shape memory material.

FIG. 4*a* and FIG. 4*b* show the different possibilities for installing a spring 8 above or below the spine piece 15 of the binding spine 11. A perspective view of both embodiments is shown in FIG. 7*a* and FIG. 7*b*.

Figure 5A:
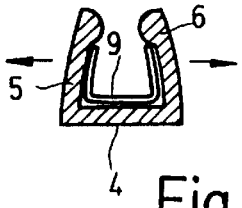
FIG. 5*a* is a cross sectional view of a first embodiment of the binding element of the present invention, utilizing a strip-shaped part made of shape memory material.
Figure 5B:
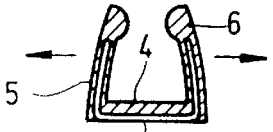
FIG. 5*b* is a cross sectional view of a second embodiment of the binding element of the present invention, utilizing a strip-shaped part made of shape memory material.
Figure 5C:
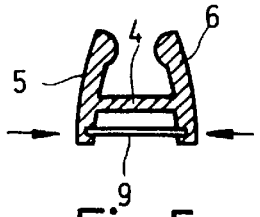
FIG. 5*c* is a cross sectional view of a third embodiment of the binding element of the present invention, utilizing a strip-shaped part made of shape memory material.

FIG. 5*a*, FIG. 5*b* and FIG. 5*c* show three different ways of how to fasten a strip-shaped insert 9 to the binding spine 11. In the embodiments of FIG. 5*a* and FIG. 5*b*, the part made of shape memory material has as cross section essentially the same form as the binding spine 11, that is, it is comprised also of a spine piece 4 and two side pieces 5, 6. The embodiment shown in FIG. 5*c* corresponds essentially to the embodiment of FIG. 4*b*, but with the spring 8 replaced by a strip-shaped insert 9.

Figure 6A:
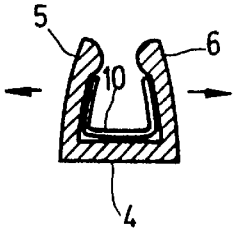
FIG. 6*a* cross sectional is a view of a first embodiment of the binding element of the present invention, utilizing a wire-shaped part made of shape memory material.
Figure 6B:
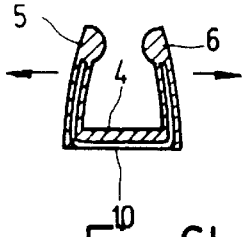
FIG. 6*b* is a cross sectional view of a second embodiment of the binding element of the present invention, utilizing a wire-shaped part made of shape memory material.
Figure 6C:
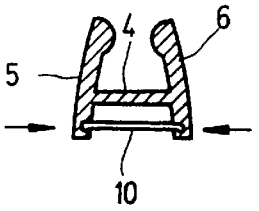
FIG. 6*c* is a cross sectional view of a third embodiment of the binding element of the present invention, utilizing a wire-shaped part made of shape memory material.

The integration of a wire-shaped part 10 in the binding spine 11 is illustrated in FIG. 6*a*, FIG. 6*b* and FIG. 6*c*. Like the embodiment with a strip-shaped part 9 illustrated in FIG. 5*a* and FIG. 5*b*, the wire 10 has essentially the form of the binding spine 1. The embodiment of FIG. 6*c* emulates the embodiments shown in FIG. 4*b* and FIG. 5*c*.

FIG. 8 is a perspective view of a further embodiment of the binding element 1 of the present invention, in which the binding element 1 is constructed as a clip, meaning that it extends only over a limited area of the side edge of the stack of documents 2. The binding element 1 is comprised of a binding spine 11 with an integrated part 7 made of shape memory material. Like the binding spine 11, the part made of shape memory material also has a spine piece 4 and two side pieces 5, 6. The binding spine 11 and the part made of shape memory material are joined together in the area of the spine pieces 15, 4 by a fastening means 12, which in the case illustrated is a rivet joint.

Figure 9A:
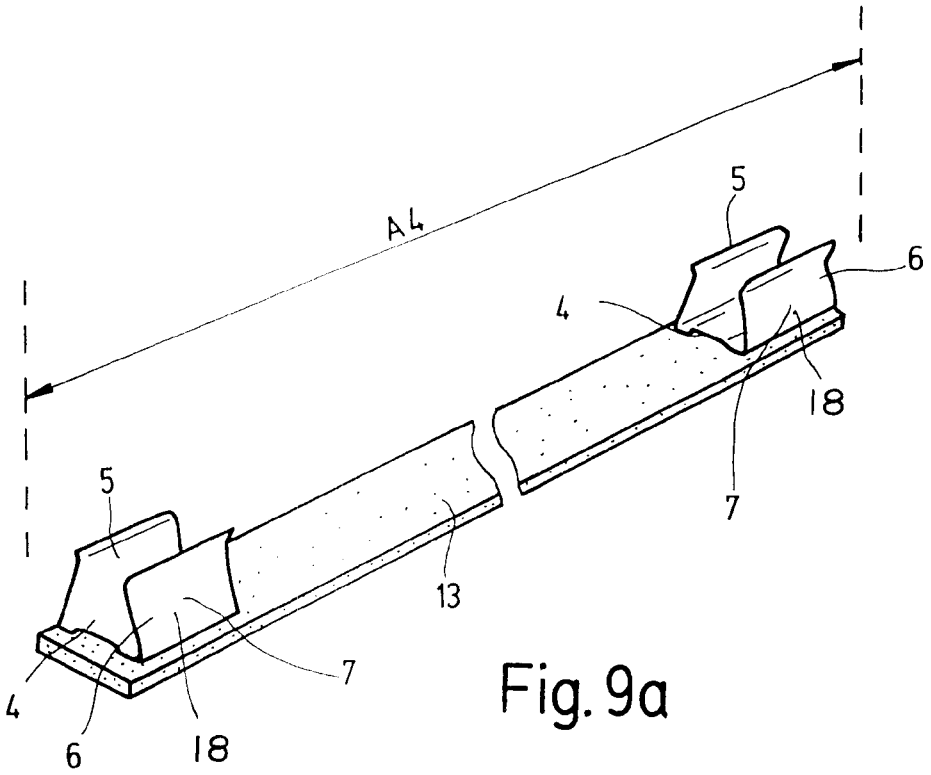
FIG. 9*a* is a perspective view of a low-cost embodiment of the binding element of the present invention.
Figure 9B:
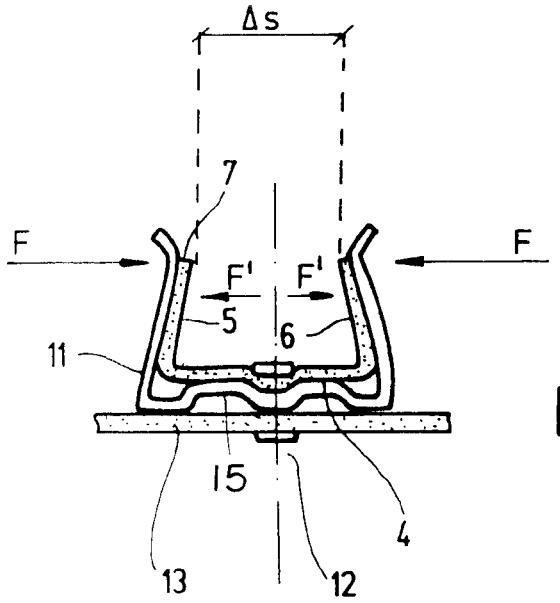
FIG. 9*b* is a cross-sectional view of a further embodiment of the binding element of the present invention.

FIG. 9*a* and FIG. 9*b* illustrate in a perspective view a low-cost embodiment of the binding element 1 of the present invention. It is comprised of two individual elements 18 having a spine piece 4 and 4, 15, and side pieces 5, 6 and 16, 17, in which the spine pieces 4 and 4, 15 of the elements 18 are connected to a further spine piece 13 whose length is coordinated with the format of the stack of documents 2 to be bound. The two elements 18 can either be made of shape memory material or they can be constructed as shown in FIG. 9*b*. In this embodiment the shape memory material comprising the spine piece 4 and the side pieces 5, 6 is integrated in the binding spine 11.

Figure 10:
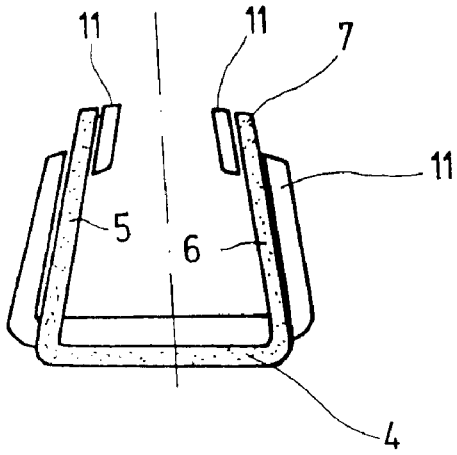
FIG. 10 is a cross-sectional view of a further variant of the binding element of the present invention.

A further variant of the binding element 1 of the present invention is illustrated in FIG. 10. A sub-section of the binding spine 11, which is made of plastic, for example, has an opening into which a correspondingly shaped part of shape memory material 7 can be inserted.

Figure 11:
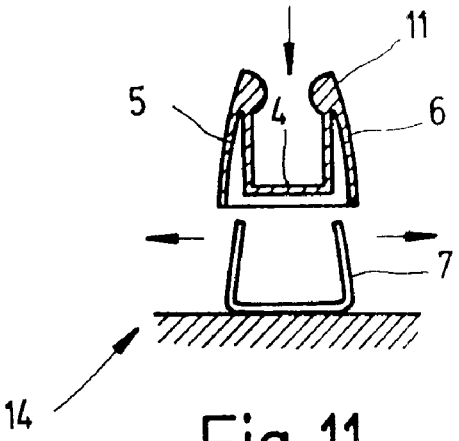
FIG. 11 is a schematic representation of the process of inserting a part made of shape memory material in a binding element by means of an applicator.
Figure 12:
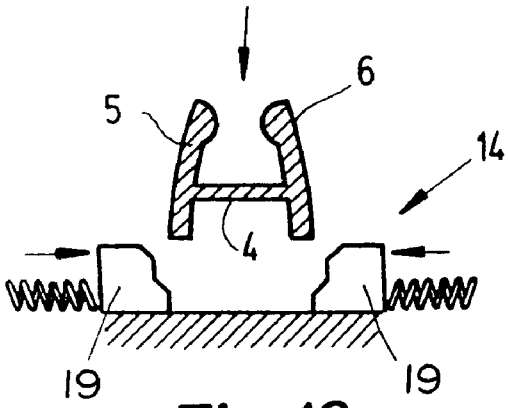
FIG. 12 is a schematic representation of the process of inserting a further part made of shape memory material in a binding element by means of an applicator.

Applicators 14 to enable the part made of shape memory material to be inserted automatically in a binding spine 11 are illustrated schematically in FIG. 11 and FIG. 12.

According to the embodiment illustrated in FIG. 11, the binding spine 11, which is made of a material displaying a relatively small elastic force, has a recess into which a correspondingly shaped part made of shape memory material is pushed from underneath. While this part is being pushed in, the two side pieces made of shape memory material are pressed apart slightly (as indicated by the two arrows), producing in the assembled state a clamping effect between the side pieces 5, 6 made of shape memory material and the side pieces 16, 17 of the binding spine 11, which is made of a material with a relatively small elastic force.

While the applicator 14 used in FIG. 11 performs a vertical movement, the two pressing members 19 of the applicator 14 shown in FIG. 12 are movable toward and away from each other in a horizontal direction. The free legs of the two side pieces 16, 17 of the binding spine 11 are pressed together by the applicator 14 by an amount sufficient to enable a correspondingly shaped part made of shape memory material to be inserted without difficulty from above.

What is claimed is:

1. A binding element for binding a stack of documents comprised of loose sheets, comprising:

a spine piece; and two spaced apart side pieces arranged substantially perpendicular to said spine piece and being, in use, biased toward each other at room temperature, thereby generating a clamping force for binding the plurality of sheets between the side pieces;

wherein the binding element comprises a shape memory material such that the side pieces are moved away from each other when the binding element is heated to a predetermined temperature above room temperature, thereby reducing the clamping force to facilitate removal of one or more of the sheets or addition of one or more extra sheets.

2. A binding element for binding a stack of documents comprised of loose sheets, comprising:

a spine piece;

two spaced apart side pieces arranged substantially perpendicular to said spine piece and being, in use, biased toward each other at room temperature thereby generating a clamping force for binding the plurality of sheets between the side pieces; and a component comprising shape memory material engageable with the side pieces, such that the side pieces are moved away from each other when said component is heated to a predetermined temperature above room temperature, thereby reducing the clamping force to facilitate removal of one or more of the sheets or addition of one or more extra sheets.

3. The binding element as defined in claim 2, wherein shape memory material parts comprise one of: parts which are inserted in and fastened to said spine piece, parts which are inserted in and fastened to said side pieces, and parts which are inserted in and fastened to said spine piece and said side pieces.

4. The binding element as defined in claim 2, wherein said component made of shape memory material comprise one of a spring, strip or wire.

5. The binding element as defined in claim 3, wherein an elastic force applied by the shape memory material component at or above the predetermined temperature is greater than that of an elastic force exerted by the binding element acting to bias the side pieces, in use, toward each other.

6. The binding element as defined in claim 3, wherein said parts made of shape memory material has essentially the form of said binding spine.

7. The binding element as defined in claim 3, wherein said spine piece includes a part made of random material according to one of: cardboard, plastic and spring steel, and wherein said parts made of shape memory material are fastened to said part of said spine piece made of random material.

8. The binding element as defined in claim 3, further comprising:

fastening means, wherein said parts made of shape memory material are one of: an integral part of one of: said spine piece, said side pieces and said spine piece and said side pieces, and fastened by said fastening means to one of: said spine piece, said side pieces and said spine piece and said side pieces.

9. A binding element for binding a stack of documents comprised of loose sheets, comprising:

a spine piece;

two spaced apart side pieces arranged substantially perpendicular to said spine piece and being, in use, biased toward each other at room temperature thereby generating a clamping force for binding the plurality of sheets between the side pieces; and a component comprising shape memory material engageable with said side pieces, such that said side pieces are moved away from each other when said component is heated to a predetermined temperature above room temperature, thereby reducing the clamping force to facilitate removal of one or more of the sheets or addition of one or more extra sheets, wherein said component made of shape memory material comprises a spring, and wherein said spring is fastened between said side pieces above said spine piece.

10. A binding element for binding a stack of documents comprised of loose sheets, comprising:

A spine piece;

two spaced apart side pieces arranged substantially perpendicular to said spine piece and being, in use, biased toward each other at room temperature thereby generating a clamping force for binding the plurality of sheets between the side pieces; and a component comprising shape memory material engageable with said side pieces, such that said side pieces are moved away from each other when said component is heated to a predetermined temperature above room temperature, thereby reducing the clamping force to facilitate removal of one or more of the sheets or addition of one or more extra sheets, wherein said component made of shape memory material comprises a spring, wherein said spine piece is located in the center zones of said side pieces, and wherein said spring is fastened between said side pieces underneath said spine piece.

* * * * *